US005476332A

United States Patent [19]

Cleveland, Jr.

[11] Patent Number: 5,476,332

[45] Date of Patent: Dec. 19, 1995

[54] SYMMETRICAL KEYBOARD APPARATUS

[76] Inventor: Ralph H. Cleveland, Jr., 17003 SW. 107 Pl., Miami, Fla. 33157

[21] Appl. No.: 251,310

[22] Filed: May 31, 1994

[51] Int. Cl.[6] ..... B41J 5/10

[52] U.S. Cl. ..... 480/486; 345/168

[58] Field of Search ..... 400/486, 489; 341/22; 345/168

[56] References Cited

U.S. PATENT DOCUMENTS 3,940,758 2/1976 Margolin ..... 400/486

4,974,183 11/1990 Miller ..... 400/486

OTHER PUBLICATIONS

The IBM XT Keyboard from 1982.

*Primary Examiner*—David A. Wiecking

*Assistant Examiner*—Steven S. Kelley

*Attorney, Agent, or Firm*—Robert M. Downey

[57] ABSTRACT

A symmetrical keyboard for computers, including computer terminals, word processors, typewriters, and similar equipment, and simulators of such equipment, wherein five rows of transverse keys are positioned and oriented in order to allow a user to move his or her left hand in a natural way that does not require unnatural "crabbing" (i.e. upward to the left and downward to the right) motions from the user's left hand. Further, the keyboard includes keys which are specifically positioned and configured so that equal numbers of letter keys are struck by each hand and opposing punctuation marks and symbols are struck by the opposing fingers of the user's left and right hands.

9 Claims, 2 Drawing Sheets

SYMMETRICAL KEYBOARD APPARATUS

BACKGROUND OF THE INVENTION

1. Field of the Invention

The present invention relates to typing keyboards, and more particularly, to symmetrical keyboards that are bio-mechanically efficient. The name keyboard refers to a computer keyboard, an extended or enhanced computer and word processor keyboard, and to a typewriter keypad portion of the extended keyboard. Symmetrical refers to the size of the keys on the keyboard, the location and arrangement of the keys, as well as the arrangement of indicia printed, engraved or embossed on the keys. Symmetrical keyboard, then, refers to the typewriter keypad portion of an enhanced keyboard and to the enhanced keyboard itself when the typewriter keypad is symmetrical.

2. Description of the Related Art

Applicant believes that the closest reference corresponds to U.S. Pat. No. 4,669,903 issued to Stuart and Barbara Herzog on Jun. 2, 1987. However, it differs from the present invention because Herzog et al. makes inefficient use of the triangular space located in the center of the keyboard. In addition, Herzog et al. does not logically and symmetrically arrange symbols and punctuation marks or control keys on their keyboard.

Other patents describing the closest subject matter provide for a number of more or less complicated features that fail to solve the problem of symmetry in an efficient and economical way. None of these patents suggest the novel features of the present invention.

SUMMARY OF THE INVENTION

The present invention is directed to keyboards that are logically and symmetrically arranged. The keyboard is also bio-mechanically efficient because approximately equal numbers of letters are struck by the right and left hands of the user and because symbol and punctuation keys are logically and symmetrically arranged so that keys having corresponding indicia are struck by the corresponding opposing fingers of the user's left and right hands. Also, the transverse rows of the keys are evenly staggered in a vertical arrangement which allows the user's left hand to move in a natural way that does not require an unnatural "crabbing" motion, also known as Left Wrist Deviation. This unnatural motion of the left hand, if continued for a long period, may cause repetitive disorders.

With the foregoing in mind, it is one of the primary objects of the present invention to provide a keyboard that is logically and symmetrically arranged and permits a user to move his or her left hand in a way that is natural and does not require an unnatural "crabbing" (ie. upward and to the left and downward to the right) motion from the user's left hand.

It is another object of the present invention to provide a keyboard that aligns the user's hands and arms to prevent or reduce the incidence of repetitive motion injuries such as carpal tunnel syndrome.

It is still another object of this invention to provide a keyboard that is bio-mechanically efficient because approximately equal numbers of letter keys are struck by the right and left hands of the user.

It is yet another object of the invention to provide a keyboard that is bio-mechanically efficient because approximately equal numbers of symbols and punctuation marks keys are struck by the right and left hands of the user.

It is still another object of this invention to provide a keyboard that is logically and symmetrically arranged so that a user can more readily visualize and recall the position of the keys on the keyboard.

It is yet another object of this invention to provide a symmetrical keyboard which resembles the established standard keyboard as much as possible but which is specifically designed to work the left and right hands evenly while using the space on the keyboard as ergonomically and efficiently as possible.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
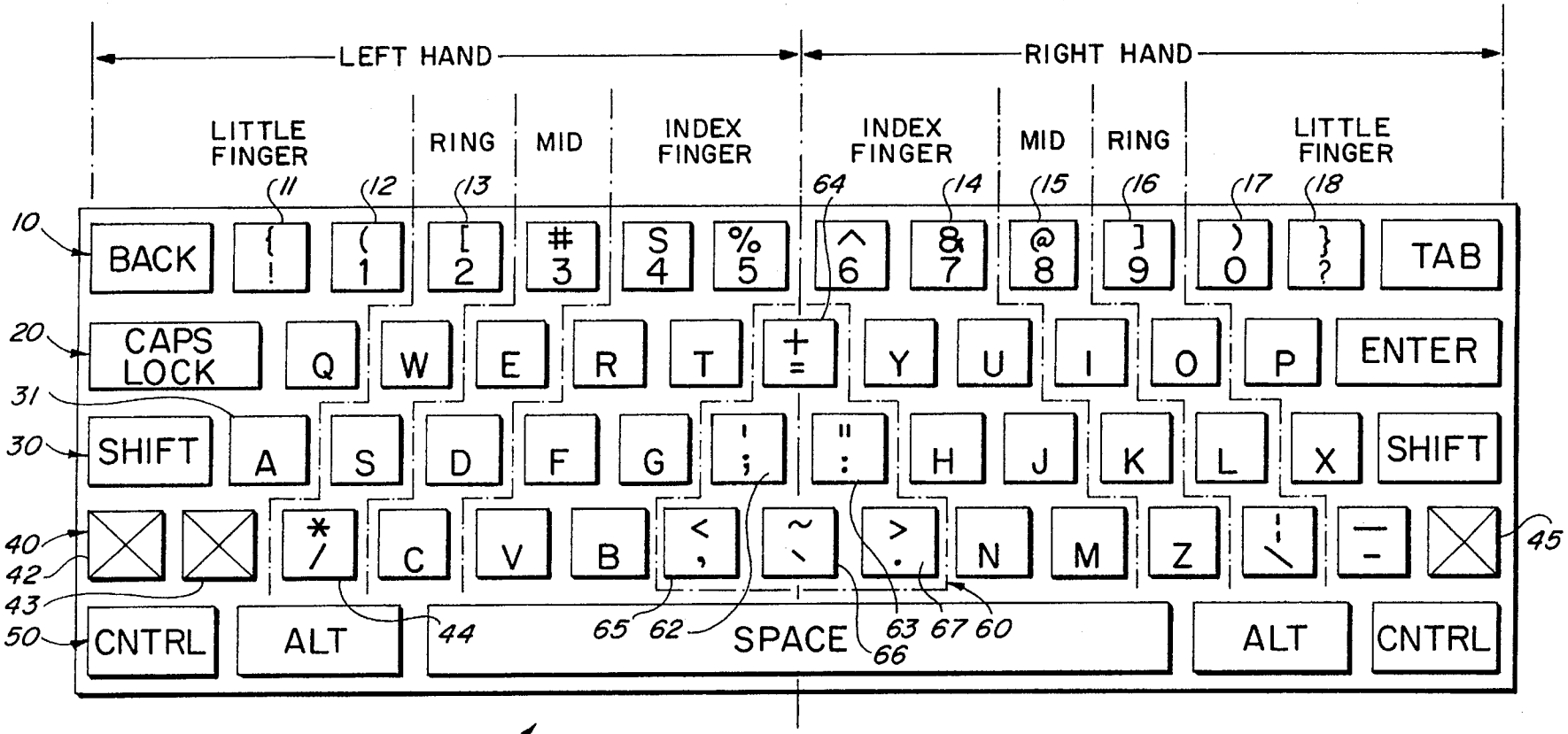
FIG. 2 shows a keyboard incorporating the teachings of the present invention.

Referring now to the drawings, and particularly FIG. 2, where the present invention is generally referred to with numeral 100, it can be observed that it basically includes five transverse rows of keys; first row 10, second row 20, third row 30, fourth row 40 and fifth row 50.

Figure 1:
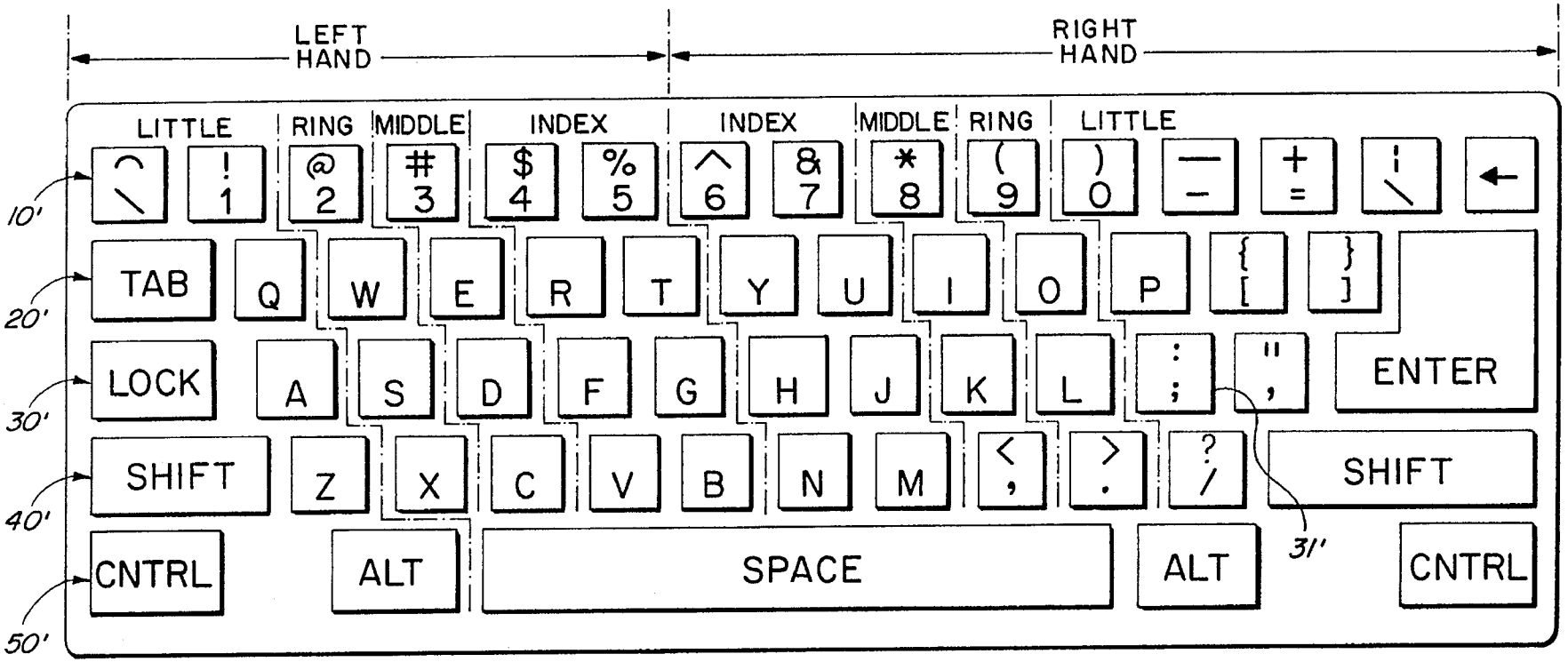
FIG. 1 (PRIOR ART)
FIG. 1 illustrates a typical conventional asymmetric keyboard.

Referring now to FIG. 1 which depicts a typical conventional typing keyboard 100' it can be seen that a conventional keyboard 100' also has five transverse rows, including; primary row 10', secondary row 20', tertiary row 30', quadiary row 40' and quintiary row 50'. On the conventional keyboard 100' the secondary row 20' is off-set to the right below the primary row 10', which comprises the number keys 1, 2, 3, 4, 5, 6, 7, 8, 9, 0 and the symbol keys `(grave accent), -(dash), =(equals), \(back slash) and the back arrow. The secondary row 20' comprises the TAB key, Q, W, E, R, T, Y, U, I, O, P, [(left square bracket) and ](right square bracket) keys. The tertiary row 30' comprises the LOCK key, A, S, D, F, G, H, J, K, L, ;(semi-colon), '(apostrophe) and ENTER keys and is off-set to the right from the secondary row 20'. The quadiary row 40' comprises the left SHIFT key, Z, X, C, V, B, N, M, ,(comma), .(period) /(forward slash), and right SHIFT key. The quadiary row 40' is off-set to the right from the tertiary row 30'. The quintiary row 50' comprises the left CNTRL key, left ALT key, SPACE bar, right ALT key and right CNTRL key.

The conventional keyboard 100' requires a user to perform an unnatural "crabbing" motion with his or her left hand. For example, the operation of the R and 4 keys require the user to extend upward and to the left, in an unnatural slanted movement known as Left Wrist Deviation. A user striking a key which is upward and to the left of the keys A, S, D, and F, home keys for the left hand, also moves his or her left forearm and elbow. This slanted bending is unnatural and if continued for a long enough period it may cause repetitive movement disorders. Similar upward and to the left movements to reach the keys located on both the primary row 10' and secondary row 20' also cause Left Wrist Deviation and may lead to repetitive motion disorders.

The two-handed touch typing method, which is utilized by most typists, dictates that a user position his or her fingers on "rest" or "home" keys A, S, D, F, for the left hand and J, K, L, and ;(semi-colon) for the right hand. The home keys are located on the tertiary row 30'. When the user desires to type a non-home key, the user extends his or her finger to strike the desired key, and after striking the desired key, returns his or her finger to the appropriate home key. The conventional two-handed touch typing method is unchanged by the symmetrical keyboard 100 of the present invention. Conventional keyboard 100' has been improved upon, by the symmetrical keyboard 100, to eliminate the unnatural "crabbing" motion of the user's left hand. The symmetrical keyboard 100 permits a user's left hand to move so that the left hand moves in the same natural motion as that of the user's right hand. All of the letters and numbers on the symmetrical keyboard are typed by the same fingers as on the standard extended or enhanced keyboard with the exception of X and Z. The two features of the symmetrical keyboard most noticeable to an already experienced typist are the reslanting of the left-hand buttons and the placement of six mark and symbol buttons in a triangle in the middle of the keyboard.

In order to improve the standard keyboard to allow a user to employ his or her left hand in a natural motion that is symmetric with the motion used by a typist's right hand, several changes have been made to conventional keyboard 100'. These changes are embodied in the symmetrical keyboard 100 of the present invention.

Firstly, the "crabbing" motion of the left hand is eliminated by repositioning or "reslanting" the left hand keys of the keyboard so that a user striking these keys moves his or her fingers in a natural motion. Secondly, some character and symbol keys have been repositioned so that an approximately equal number of letter and symbol keys are struck by each hand. Thirdly, some keys have been reconfigured and/or repositioned.

Referring now to FIG. 2, it can be seen that the symmetrical keyboard 100 incorporates a number of significant improvements over the conventional keyboard 100'. Firstly, as can best be seen in FIG. 2, the "crabbing" motion of the left hand is eliminated by repositioning the left hand keys of the second row 20 third row 30 and fourth row 40 so that a user desiring to strike a key in the first row 10 or second row 20 or fourth row 40 moves his or her fingers in a natural motion. For example, a user who desires to strike the letter Q, found in second row 20, will do so by moving his or her little finger upward and to the right from the home key A, found in the third row 30. It can be seen that a user, employing a conventional keyboard 100', found in FIG. 1, would have to move his or her little finger upward and to the left from the home key A, found in tertiary row 30', to strike the Q key found in the secondary row 20'. This is an unnatural motion for the left hand. Similarly, a user employing conventional keyboard 100' and desiring to strike the C key, found in the quadiary row 40' of FIG. 1, would have to move his or her hand in an unnatural downward and to the right motion to reach the C key from the D home key, found in the tertiary row 30'. A user employing symmetrical keyboard 100 would strike the C key, found in fourth row 40, by moving his or her left hand's middle finger down and to the left to depress the C key. Because the left hand keys of the second row 20 have been repositioned one key to the left of their positions found on the conventional keyboard 100'; the left hand keys of the third row 30 have been repositioned two keys to the left of their positions found on the conventional keyboard 100'; and the letter keys C,V,and B of the fourth row 40 have been repositioned three keys to the left of their positions found on the conventional keyboard 100', the unnatural "crabbing" motion required when a user employs a conventional keyboard 100' is eliminated. In addition, the new alignment of first row 10, second row 20 and fourth row 40 in relation to third row 30, the home key row, permits a user to utilize his or her left hand in a natural motion that is symmetrical with the natural motion used by a typist's right hand.

Throughout the following description, keys are referred to by only a single character. For example, The "A" key, located on the third row 30, of symmetrical keyboard 100, and tertiary row 30', of conventional keyboard 100' can be struck by a user in two ways. The first way is with either of the Shift keys, found at each end of the quadiary row 40', on conventional keyboard 100', and at the ends of the third row 30, on symmetrical keyboard 100 depressed. A user depressing both the SHIFT and key 31, will print a capital "A". A user depressing only key 31 will print a lower case "a". Similarly, a user striking key 11, without also depressing both SHIFT, will print an "exclamation point". If the user depresses the Shift key and also strikes key 11 he will print a "{" (left brace). The characters printed when both the SHIFT and another key are struck will be referred to as supra-characters throughout the following description. When reference is made to a key without stating that the SHIFT key is also utilized, it is intended to be describing either the lower case letter or the bottom character found on the key. For example, the "+/=":(plus/equals) key prints an "=" (equals) when struck with the SHIFT not depressed. The supra-character "+" (plus) is produced when the "+/=" (plus/equals) key is struck and the SHIFT is also depressed. Throughout the description, keys will be referred to, except when explicitly stated, by their non-SHIFT character.

Eight keys have been merely repositioned in order to ensure a logical and symmetrical arrangement of symmetrical keyboard 100. These keys are the "=" (equal), "," (comma), "`" (grave accent), "." (period), "\" (back slash), "-" (hyphen), "x" and "z" keys.

Furthermore, a number of keys with symbol and punctuation marks have been reconfigured in order to improve upon conventional keyboard 100'. Referring now to FIG. 1, it can be seen that nine keys have been reconfigured with different supra-characters. The reconfigured keys are designed to maximize the symmetry of the symmetrical keyboard 100 and to position the more frequently utilized keys in positions where they can be more readily struck by the user's fingers. Of the nine keys, six of them seen in FIG. 2, first row 10, have new supra-characters: key 11, with the character "!" (exclamation) now has the supra-character "{" (left brace), key 12 with the character "1" now has the supra-character "(" (open parenthesis), key 13 with the character "2" now has the supra-character "[" (left square bracket), key 15 with the character "8" now has the supra-character "@", key 16 with the character "9" now has the supra-character "]" (right square bracket), and key 18 with the character "?" (question mark) now has the supra-character"}" (right brace). Two keys, seen in FIG. 2, third row 30, have new supra characters. Key 62 with the character ";" (semi-colon) now has the supra-character "'" (apostrophe), and key 63 with the character ":" (colon) now has the supra-character """" (quotes). One key, seen in FIG. 2, fourth row 40, key 44 with the character "\" (forward slash) now has the supra character "*" (star).

Also, because the punctuation symbols "!", "? " and ":" are frequently utilized by typists, they have been promoted from supra-characters and now are characters that a user may access without striking the SHIFT key. Keys 62, 63, 64, 65, 66 and 67 have been repositioned to the central triangle 60 so as to be readily struck by the user's index fingers.

Some keys have been reconfigured and/or repositioned so that corresponding symbols, such as the left square bracket "[" and right square bracket "]" are struck by the opposing corresponding fingers on the left and right hands. For example, on symmetrical keyboard 100 left square bracket "[" is struck by a user's left ring finger and is located in first row 10. The right square bracket "]" is also found on the first row 10 and is struck by a user's right ring finger. On conventional keyboards 100 a user strikes both left square bracket "[" and right square bracket "]" with the little finger of the right hand. Because opposing punctuation keys, on the symmetrical keyboard 100, are struck by the same corresponding fingers on opposing hands, a user can more readily, and logically, recall their positions and more accurately type the desired punctuation symbols. In addition, a number of punctuation and symbol keys have been relocated to a central triangle 60 that is outlined by dashed lines in FIG. 2. Because these punctuations and symbols are frequently utilized, they have been repositioned where they can be easily struck by a user's index fingers. Two keys, "`" (grave accent) and "=" (equals) may be struck by either index finger, as convenient. Also, the letters "x" and "z" have been moved from the left half of the keyboard, where they are struck by the fingers of the left hand, to a position on the right half of symmetrical keyboard 100, where they are struck by the fingers of the right hand. This repositioning means that both the left and right halves of the symmetrical keyboard 100 have 13 letter keys and ensures that each hand will have a substantially equal work load. This is an improvement over conventional keyboard 100' which has 15 letters on it's left half and only 11 on it's right half.

Referring now to FIG. 1, it can be seen that on a conventional keyboard 100' key 31, has the character ";" (semi-colon) and the supra-character ":" (colon). Key 31' is struck by a user's right little finger. Because the little finger is not as strong or as dexterous as the index finger, positioning these symbols where they can be easily accessed is a significant improvement over the conventional keyboard 100'.

In addition, the reconfiguration and reorganization of conventional keyboard 100' has permitted three keys on symmetrical keyboard 100 to be left blank. It is anticipated that these keys 42, 43 and 45 will be used for new characters and/or controls as they are required.

The forgoing description conveys the best understanding of the objectives and advantages of the present invention. Different embodiments may be made of the invention concept of this invention. It is to be understood that all matter disclosed herein is to be interpreted merely as illustrative, and not in a limiting sense. Accordingly, it is recognized that departures may be made within the spirit and scope of the following claims which, therefore, should not be limited except within the Doctrine of Equivalents.

Now that the invention has been described,

What is claimed is:

1. A keyboard for computers, computer terminals, word processors, typewriters, and similar equipment, and simulators of such equipment, the keyboard having a plurality of keys including control keys and type keys, the type keys including keys having numerals, symbols, and punctuation marks thereon, and 26 alphabet keys each having a single letter of the alphabet thereon, said keyboard comprising:

a plurality of transverse rows of said keys, including at least a first row, a second row, a third row, a fourth row, and a fifth row, said plurality of transverse rows being divided by a vertical centerline to define a left zone of said keys and a right zone of said keys, with the arrangement, including the size, configuration, and position of said keys in said left zone being symmetrical to the arrangement of said keys in said right zone relative to said centerline, said left and right zones including an equal number of keys therein, said left zone including 13 of said alphabet keys and said right zone including 13 of said alphabet keys, said type keys including a plurality of pair sets including:

a first pair set including a first key in said left zone having a left brace symbol thereon and a second, corresponding key in said right zone having a right brace symbol thereon, said first and second keys of said first pair set each being spaced an equal number of keys to the left and the right of said centerline respectively, a second pair set including a first key in said left zone having an open parenthesis symbol thereon and a second, corresponding key in said right zone having a closed parenthesis symbol thereon, said first and second keys of said second pair set each being spaced an equal number of keys to the left and the right of said centerline respectively, a third pair set including a first key in said left zone having a left bracket symbol thereon and a second, corresponding key in said right zone having a right bracket symbol thereon, said first and second keys of said third pair set each being spaced an equal number of keys to the left and the right of said centerline respectively, a fourth pair set including a first key in said left zone having a forward slash symbol thereon and a second, corresponding key in said right zone having a back slash symbol thereon, said first and second keys of said fourth pair set each being spaced an equal number of keys to the left and the right of said centerline respectively, and a fifth pair set including a first key in said left zone having a "less than" symbol thereon and a second, corresponding key in said right zone having a "greater than" symbol thereon, said first and second keys of said fifth pair set each being spaced an equal number of keys to the left and the right of said centerline respectively.

2. A keyboard as in claim 1 wherein at least two of said plurality of keys are bisected by said vertical centerline.

3. A keyboard as in claim 1 wherein said control keys include a space bar in said fifth row, said space bar being bisected by said vertical centerline.

4. A keyboard as in claim 1 wherein said first transverse row has an even number of keys.

5. A keyboard as in claim 4 wherein said first transverse row has 14 keys, said second row has 13 keys, said third row has 14keys, said fourth row has 15 keys and said fifth row has 5 keys.

6. A keyboard as in claim 5 wherein opposite end keys in each row are of the same size.

7. A keyboard as in claim 6 wherein said keys are 3 sizes including square, 1.5 times as wide as high, and two times as wide as high.

8. A keyboard as in claim 1 wherein said transverse rows are assigned the following characters in sequence from left to right:

first transverse row: BACK SPACE,!,1,2,3,4,5,6,7,8,9,0,? and TAB; second transverse row: CAPS LOCK,Q,W, E,R,T,=,Y,U,I,O,P, and ENTER; third transverse row: SHIFT, A,S,D,F,G,;,:,H,J,K,L,X and SHIFT; fourth transverse row: /,C,V,B,,(comma),`,.(period),N,M,Z,\, and -; fifth transverse row: CNTRL, ALT, SPACE, ALT and CNTRL.

9. A keyboard for computers, including computer terminals, word processors, typewriters, and similar equipment, and simulators of such equipment, an improvement comprising: five transverse rows of keys, wherein said transverse rows are assigned the following characters in sequence from left to right:

first transverse row: BACK SPACE,!,1,2,3,4,5,6,7,8,9,0,? and TAB; second transverse row: CAPS LOCK,Q,W, E,R,T,=,Y,U,I,O,P and ENTER; third transverse row: SHIFT,A,S,D,F,G,;,:,H,J,K,L,X, and SHIFT; fourth transverse row:/,C,V,B,,(comma),`,.(period),N,M,Z,\, and -;

fifth transverse row: CNTRL, ALT, SPACE, ALT and CNTRL.

* * * * *